US009695673B1

(12) United States Patent
Latiolais

(10) Patent No.: US 9,695,673 B1
(45) Date of Patent: Jul. 4, 2017

(54) DOWN HOLE WASH TOOL

(71) Applicant: Oilfield Solutions and Design, LLC, New Iberia, LA (US)

(72) Inventor: Brian J. Latiolais, St. Martinville, LA (US)

(73) Assignee: Oilfield Solutions and Design, LLC, New Iberia, LA (US)

( * ) Notice: Subject to any disclaimer, the term of this patent is extended or adjusted under 35 U.S.C. 154(b) by 0 days.

(21) Appl. No.: 14/092,832

(22) Filed: Nov. 27, 2013

Related U.S. Application Data

(60) Provisional application No. 61/796,989, filed on Nov. 28, 2012.

(51) Int. Cl.
*E21B 37/00* (2006.01)
*E21B 34/06* (2006.01)

(52) U.S. Cl.
CPC ..... *E21B 37/00* (2013.01); *E21B 34/06* (2013.01)

(58) Field of Classification Search
CPC ..... E21B 37/00; E21B 37/08; E21B 41/0078; E21B 7/18
See application file for complete search history.

(56) References Cited

U.S. PATENT DOCUMENTS 2,059,630 A * 11/1936 Erwin ..... E21B 37/08 166/150
2,100,807 A * 11/1937 Kinley ..... E21B 37/08 166/222
3,841,559 A * 10/1974 Hall ..... B05B 12/06 175/424
3,897,836 A * 8/1975 Hall ..... E21B 4/00 175/424
3,952,832 A * 4/1976 Elmore ..... E21B 7/14 181/116
4,345,646 A * 8/1982 Terrell ..... E21B 23/04 166/212
4,441,557 A 4/1984 Zublin
4,518,048 A * 5/1985 Varley ..... E21B 7/065 175/320
4,625,799 A * 12/1986 McCormick ..... E21B 23/006 134/167 C
4,819,728 A * 4/1989 Lafitte ..... E21B 29/02 166/298
5,337,819 A * 8/1994 Tailby ..... E21B 41/0078 166/222
5,836,393 A * 11/1998 Johnson ..... E21B 28/00 166/177.5
6,039,117 A * 3/2000 Mueller ..... E21B 37/08 166/312

(Continued)

*Primary Examiner* — Jennifer H Gay
(74) *Attorney, Agent, or Firm* — Jones Walker LLP

(57) ABSTRACT

A tool for cleaning valves and other devices in subterranean wells. The tool is cylindrical in shape and has several components, including a pressurized gas housing, a fluid housing, and multiple jet ports extending radially. The tool is lowered into the subterranean well and positioned so that the multiple ports are aligned with the valve or other device to be cleaned. A jarring action on the tool releases the pressurized gas into the fluid housing, thereby forcing the fluid out of the fluid housing and through the multiple jet ports. The fluid flowing through the multiple jet ports cleans the valve or other device.

21 Claims, 12 Drawing Sheets

(56) References Cited

U.S. PATENT DOCUMENTS

| | | | | |
|---|---|---|---|---|
| 6,189,618 | B1 * | 2/2001 | Beeman | E21B 34/14 166/194 |
| 6,250,388 | B1 * | 6/2001 | Carmi | B08B 7/0007 166/249 |
| 6,568,472 | B1 | 5/2003 | Gano et al. | |
| 7,011,158 | B2 * | 3/2006 | Davis | E21B 37/00 166/177.7 |
| 7,987,906 | B1 | 8/2011 | Troy | |
| 8,931,558 | B1 * | 1/2015 | Harper | E21B 4/02 134/167 C |
| 2009/0301744 | A1 * | 12/2009 | Swinford | E21B 4/14 173/200 |
| 2010/0155054 | A1 * | 6/2010 | Innes | E21B 27/02 166/165 |
| 2013/0133893 | A1 * | 5/2013 | Anderson | E21B 21/12 166/311 |
| 2014/0054092 | A1 * | 2/2014 | Buckman, Sr. | E21B 7/18 175/107 |
| 2015/0308232 | A1 * | 10/2015 | Hallundbaek | E21B 23/03 166/312 |

* cited by examiner

DOWN HOLE WASH TOOL

CROSS REFERENCE TO RELATED APPLICATIONS

The present application claims priority from provisional patent application No. 61/796,989, filed on Nov. 28, 2012.

FIELD OF THE INVENTION

The subject invention relates to a tool for cleaning valves and other devices in subterranean wells.

BACKGROUND

Down hole safety valves are a critical component in oil and gas wells. They act as a failsafe to prevent the uncontrolled release of reservoir fluids in the event of a worst case scenario surface disaster.

Down hole safety valves are typically cylindrical in shape. They are installed in the production tubing and are typically held in the open position by a high-pressure hydraulic line extending from the surface. They are placed as far below the surface as is deemed safe to avoid the effects of surface disasters.

Down hole safety valves are commonly uni-directional flapper valves which open downwards. With this configuration, the flow of fluids from the surface cause the valve to open, while the flow of fluids from the well bore cause the valve to close.

Down hole safety valves occasionally accumulate scale, sand, and other 10 debris on the parts of the valves that create a seal. The scale, sand, and other debris prevent the valves from sealing, which basically renders the valves useless. In the past, operators attempted, with limited success, to remove the scale, sand, and other debris by running coil tubing down the well and introducing a solvent into the profile of the valves. The purpose of the solvent was to dissolve and/or flush out the scale, sand, and other debris from the seal.

Operators also attempted to remove the scale, sand, and other debris by running a nipple brush into the profile of the valves. Because the valves were required to be in the open position when the nipple brush was positioned in the profile of the valves, the brushing action of the nipple brush would only affect the flow tube, and not necessarily the seal.

The present invention is designed to remove scale, sand, and other debris from down hole safety valves to enable a non-sealing valve to once again seal when in the closed position.

BRIEF DESCRIPTION OF THE DRAWINGS

The accompanying drawings are provided for the purpose of illustration only and are not intended as a definition of the limits of the present invention. The drawings illustrate a preferred embodiment of the present invention, wherein.

DESCRIPTION OF THE INVENTION

While the present invention will be described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the present invention not be limited to the particular embodiments disclosed as the best mode contemplated for carrying out this invention, but that the invention will include all embodiments (and legal equivalents thereof).

Figure 1:
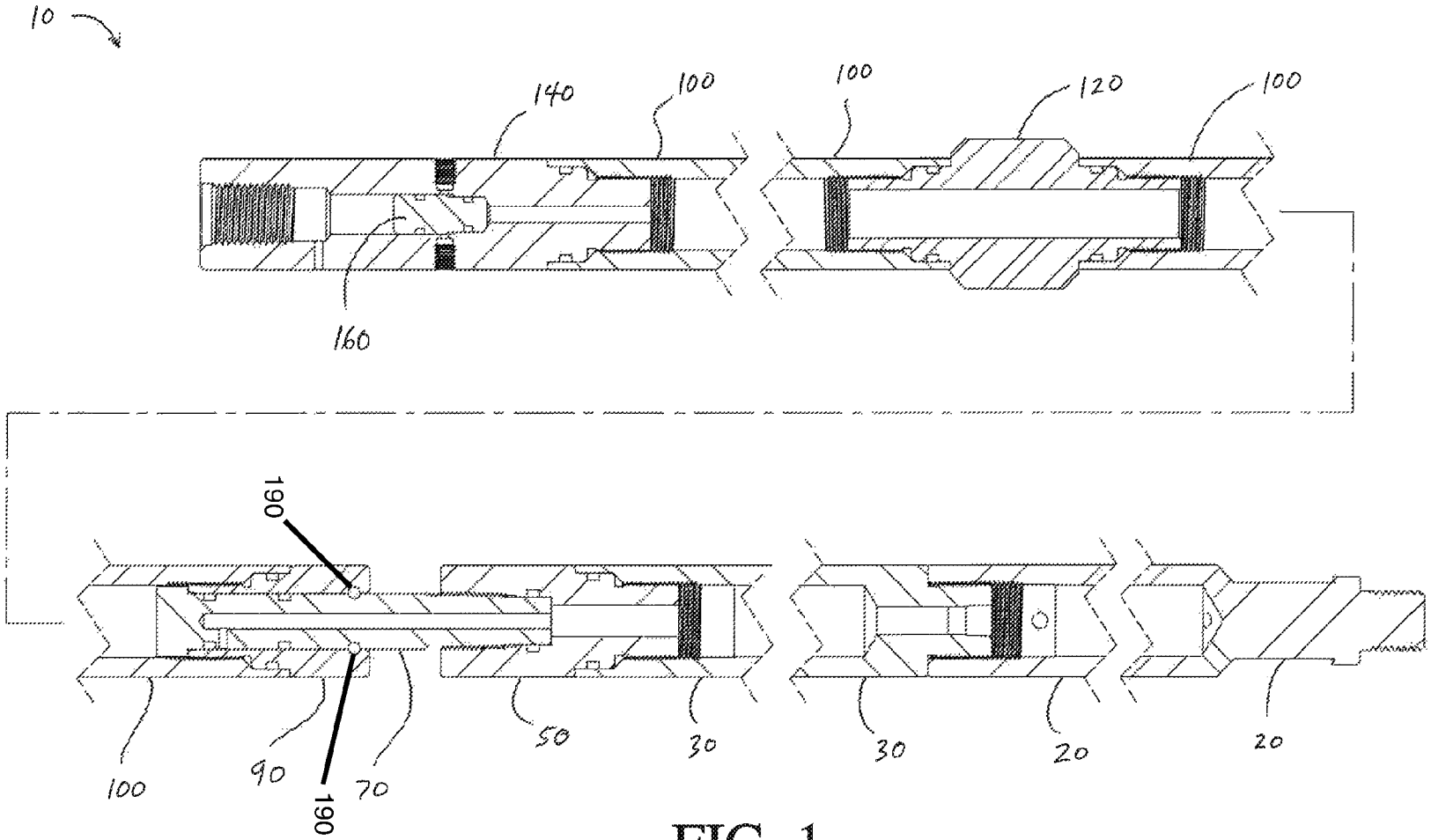
FIG. 1 is a cutaway view of the present invention, with the gas chamber fully charged.
Figure 2:
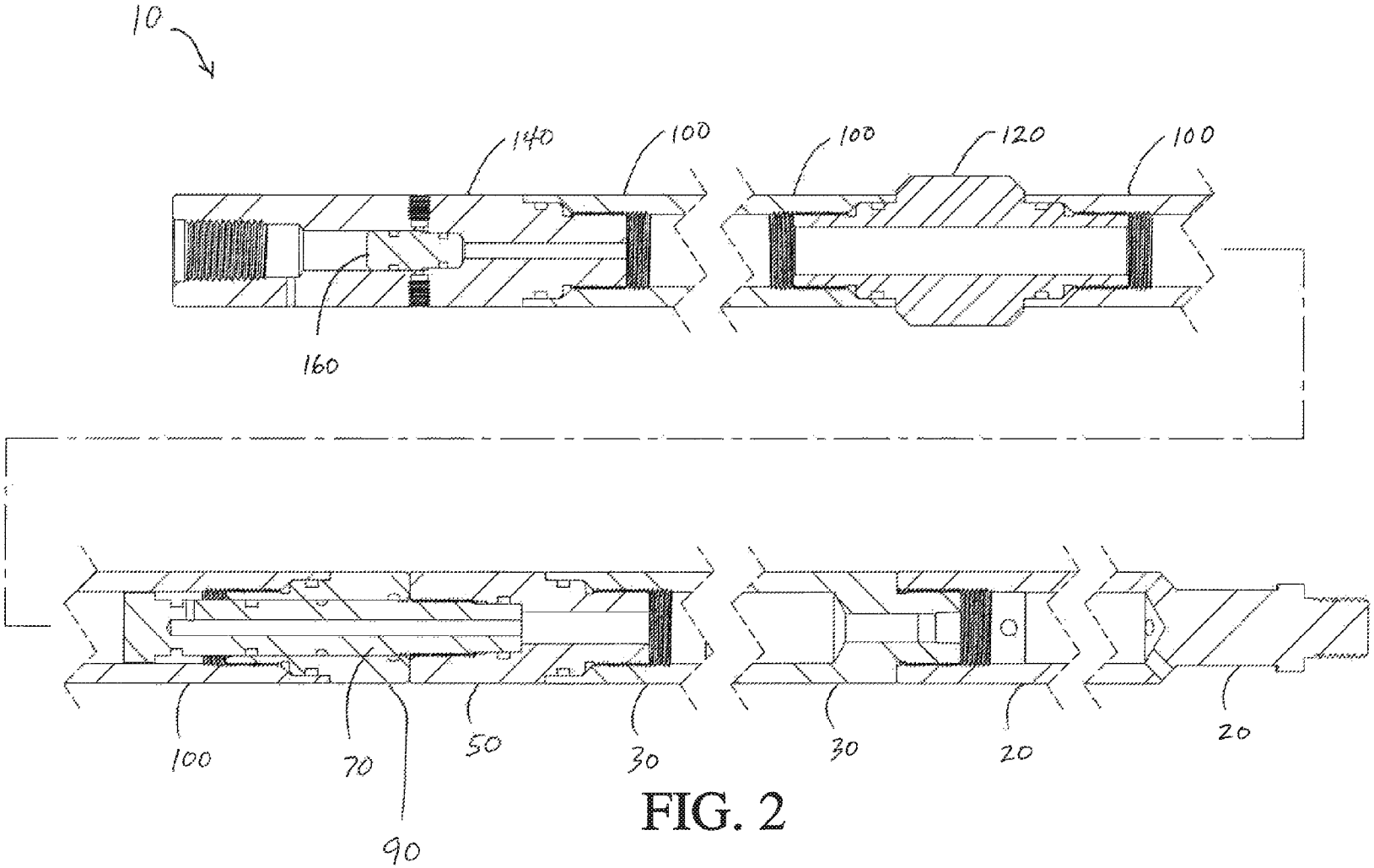
FIG. 2 is another cutaway view of the present invention, with the gas chamber discharged.

As shown in FIGS. 1 and 2, the preferred embodiment of present invention 10 includes several component parts, including a top sub 20, a gas housing 30, a core top sub 50, a core 70, a core sub 90, a fluid housing 100, a no-go 120, a jet sub 140, and a jet sub piston 160. The components of the present invention 10, except for the o-rings, are preferably manufactured using strong, rigid, corrosive resistant materials.

Figure 3:
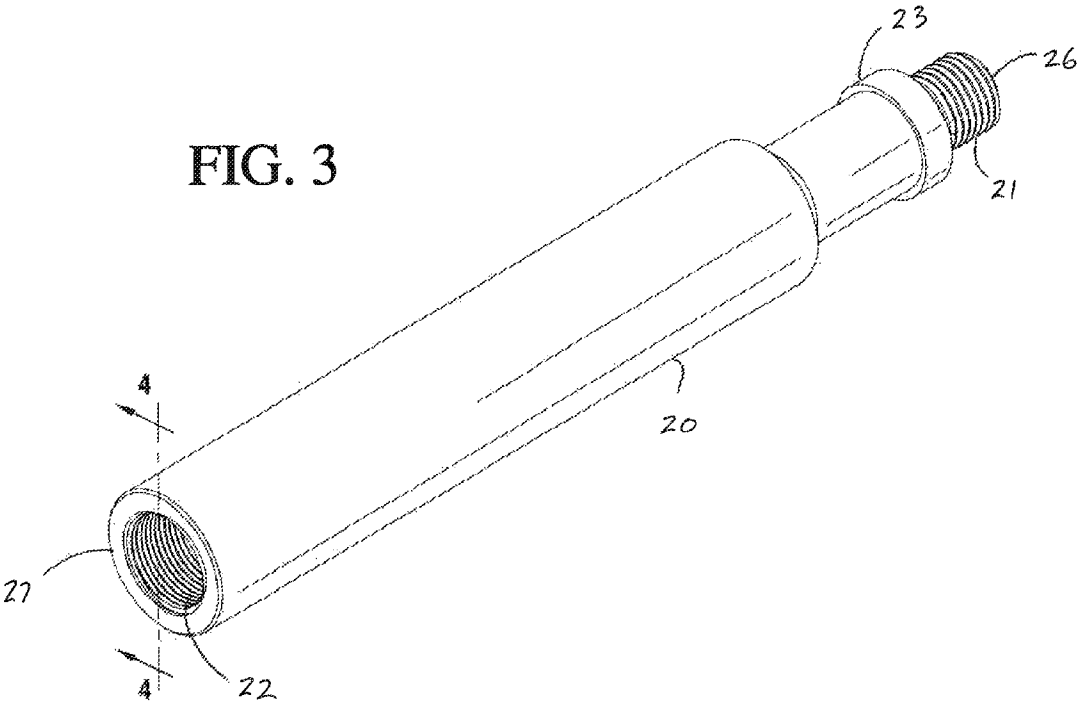
FIG. 3 is a perspective view of the top sub component of the present invention.
Figure 4:
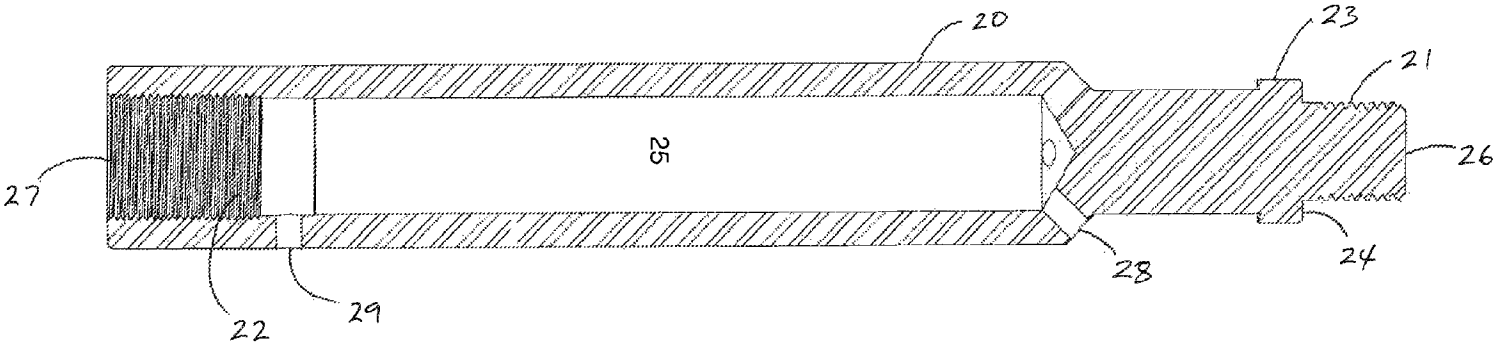
FIG. 4 is a cutaway view of the top sub component of the present invention.

As shown in FIGS. 3 and 4, top sub 20 is generally cylindrical in shape. Top sub 20 has a male thread 21 at one end 26 and a female thread 22 at the other end 27. Male thread 21 of top sub 20 is designed to connect with a spang jar on a slickline work string (not shown). Outer ring 23 adjacent to end 26 provides a shoulder 24 against which the spang jar stops when threaded onto male thread 21. In the preferred embodiment, top sub 30 can be equipped with a vent 28 and a drain 29.

Top sub 20 has a cavity 25 which is designed to cover and protect a quick connection and check valve (not shown). The quick connection and check valve allow the user of present invention 10 to pressurize gas housing 30 to a desired working pressure, and to maintain said pressure within gas housing 30, as discussed in more detail below.

Figure 5:
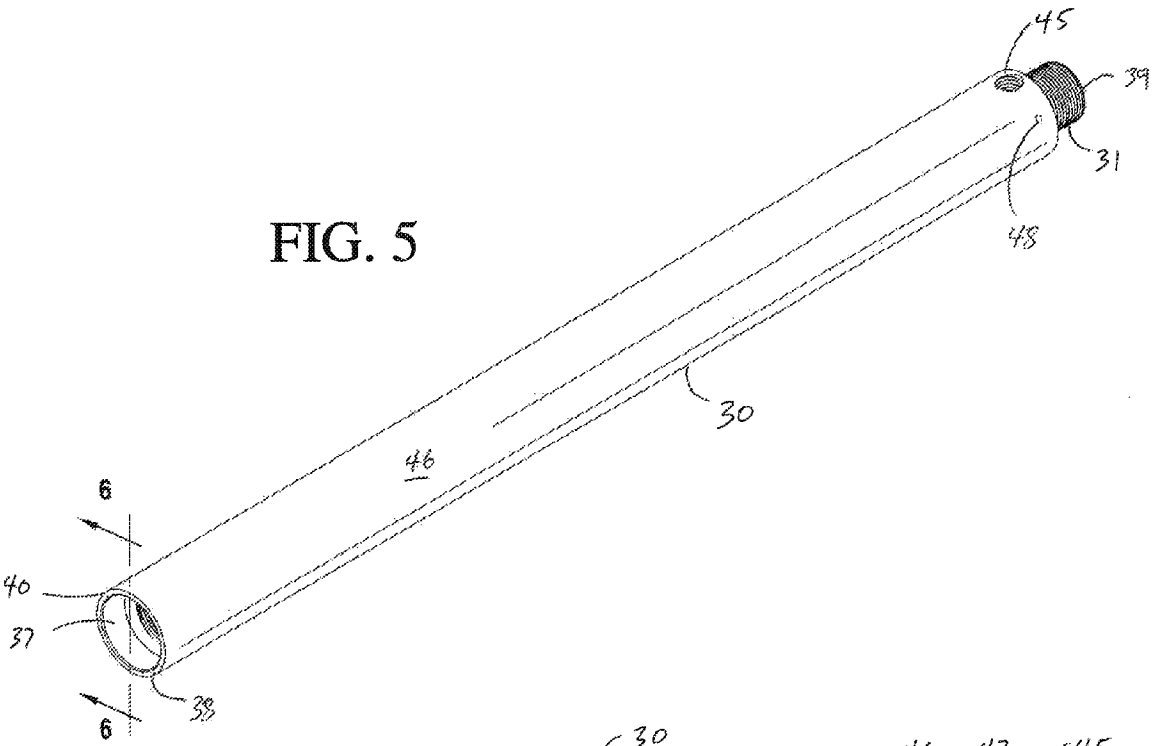
FIG. 5 is a perspective view of the gas housing component of the present invention.
Figure 6:
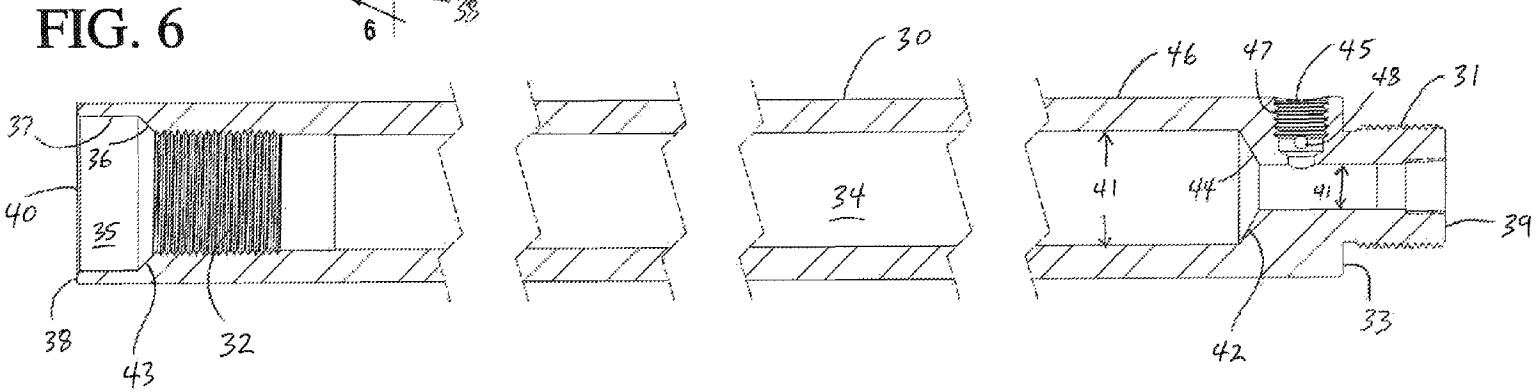
FIG. 6 is a cutaway view of the gas housing component of the present invention.

As shown in FIGS. 5 and 6, gas housing 30 is generally cylindrical in shape. Gas housing 30 has a male thread 31 at one end 39 and a female thread 32 at the other end 40. Female thread 32 is recessed within gas housing 30, thereby creating an opening 35 with a bevel 36, an inner wall 37, and a flange 38. Shoulder 33 adjacent to male thread 31 provides a stop against which the top sub 20 stops when threaded onto male thread 31 of gas housing 30.

Gas housing 30 is equipped with gas chamber 34 used to store pressurized gas (preferably an inert gas, such as nitrogen), which can be discharged into fluid chamber 101 of fluid housing 100, as discussed in more detail below. Gas chamber 34 extends from one end 39 of gas housing 30 to the other end 40. Beginning at end 39, inner diameter 41 of gas chamber 34 increases at different locations 42 and 43. Beginning at end 39, inner diameter 41 of gas chamber 34 is approximately 0.44 inches. At change-of-diameter location 42, inner diameter 41 increases from approximately 0.44 inches to approximately 1.1 inches, resulting in bevel 44 at change-of-diameter location 42. At change-of-diameter location 43, inner diameter 41 increases from approximately 1.1 inches to approximately 1.5 inches, resulting in bevel 36.

Gas housing 30 is preferably equipped with a pressure relief port 45, which is preferably located between end 39 and change-in-diameter location 42. Pressure relief port 45 extends radially from gas chamber 34 to outer surface 46 of gas housing 30. Pressure relief port 45 preferably has female threads 47 for receiving a pressure relief plug (not shown) for relieving pressure from within gas chamber 34. When pressure relief from within gas chamber 34 is desired, pressure relief plug is rotated counter-clockwise to expose pressure relief outlet 48, which extends radially from pressure relief port 45 to outer surface 46 of gas housing 30. Once pressure relief outlet 48 is exposed, then any pressurized gas within gas chamber 34 will release through pressure relief outlet 48.

Figure 7:
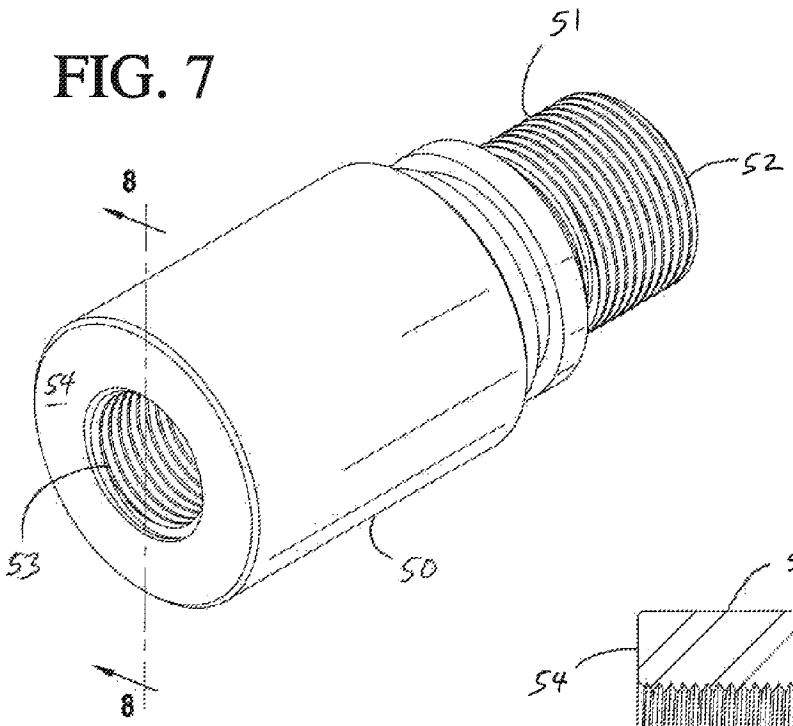
FIG. 7 is a perspective view of the core top sub component of the present invention.
Figure 8:
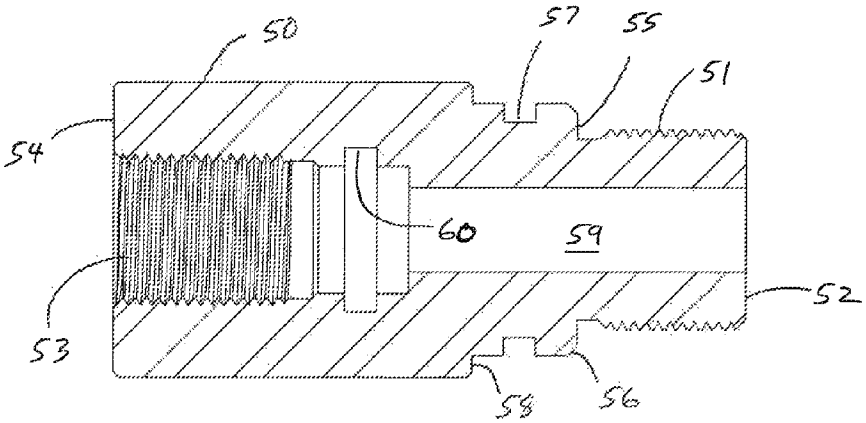
FIG. 8 is a cutaway view of the core top sub component of the present invention.

As shown in FIGS. 7 and 8, core top sub 50 is generally cylindrical in shape. Core top sub 50 has a male thread 51 at one end 52 and a female thread 53 at the other end 54. Adjacent to male thread 51 is first shoulder 55, which has a beveled edge 56. Adjacent to first shoulder 55 is outer o-ring groove 57. Adjacent to outer o-ring groove 57 is second shoulder 58.

Core top sub 50 has a longitudinal bore 59 extending from one end 52 to the other end 54. Longitudinal bore 56 has an inner o-ring groove 60 adjacent to female thread 53.

Figure 9:
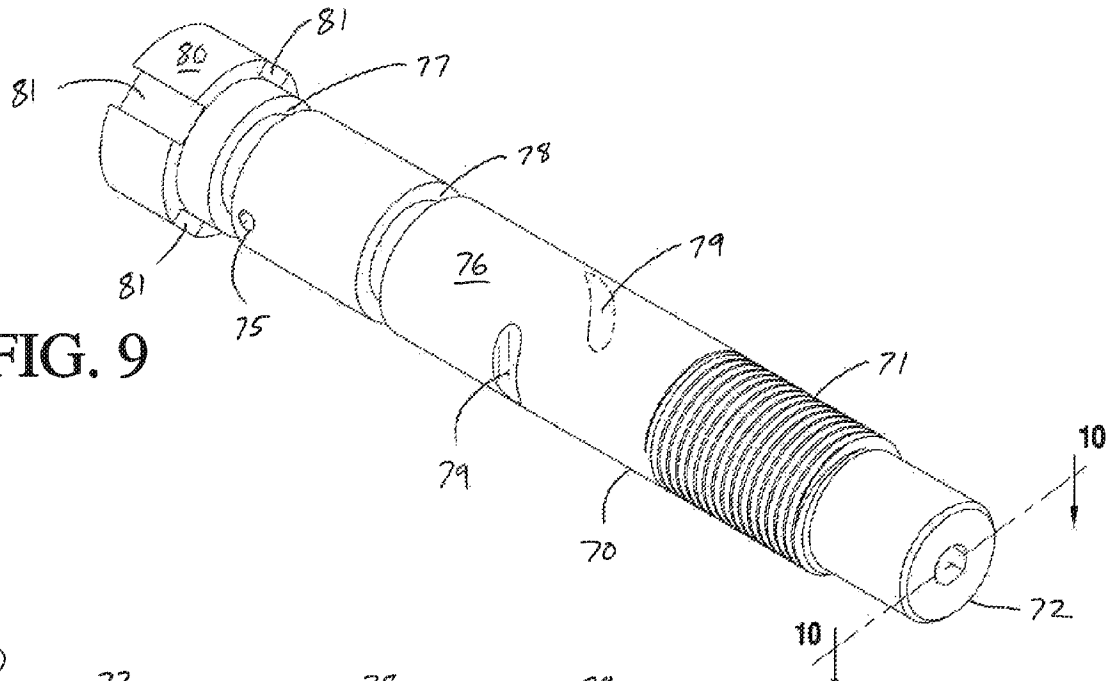
FIG. 9 is a perspective view of the core component of the present invention.
Figure 10:
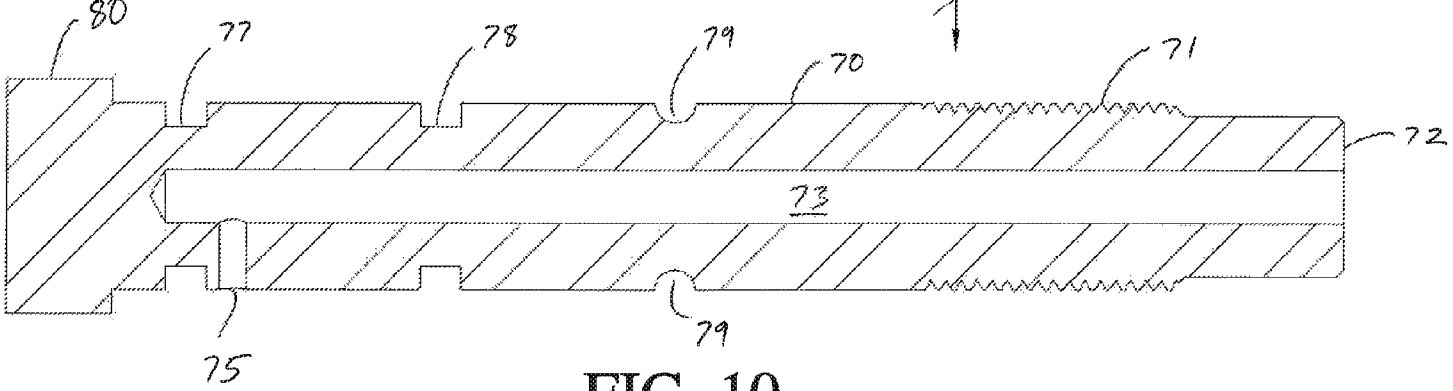
FIG. 10 is a cutaway view of the core component of the present invention.

As shown in FIGS. 9 and 10, core 70 is generally cylindrical in shape. Core 70 has a male thread 71 near one end 72. Core 70 has a longitudinal bore 73 extending from end 72 to near the other end 74. Port 75 extends from bore 73 to outer surface 76 of core 70 near end 74. Port 75 reaches outer surface 76 between outer o-ring grooves 77 and 78. Core 70 has two tangent pin grooves 79 on outer surface 76 between male thread 71 and outer o-ring groove 78. Core 70 has a head 80 at end 74. Head 80 is equipped with slots 81 for allowing the passage of gas from inside gas housing 30, as discussed in more detail below.

Figure 11:
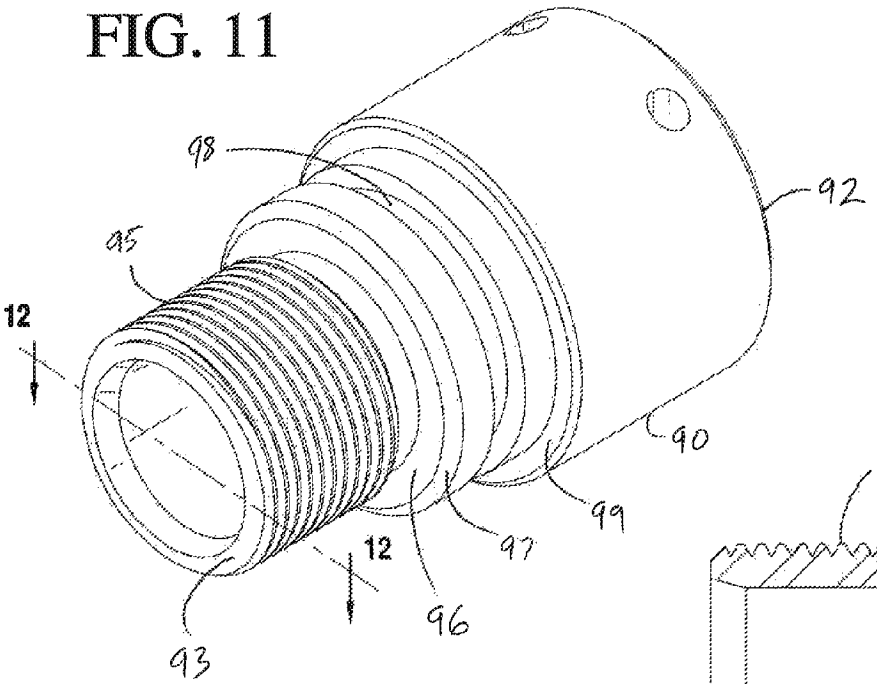
FIG. 11 is a perspective view of the core sub component of the present invention.
Figure 12:
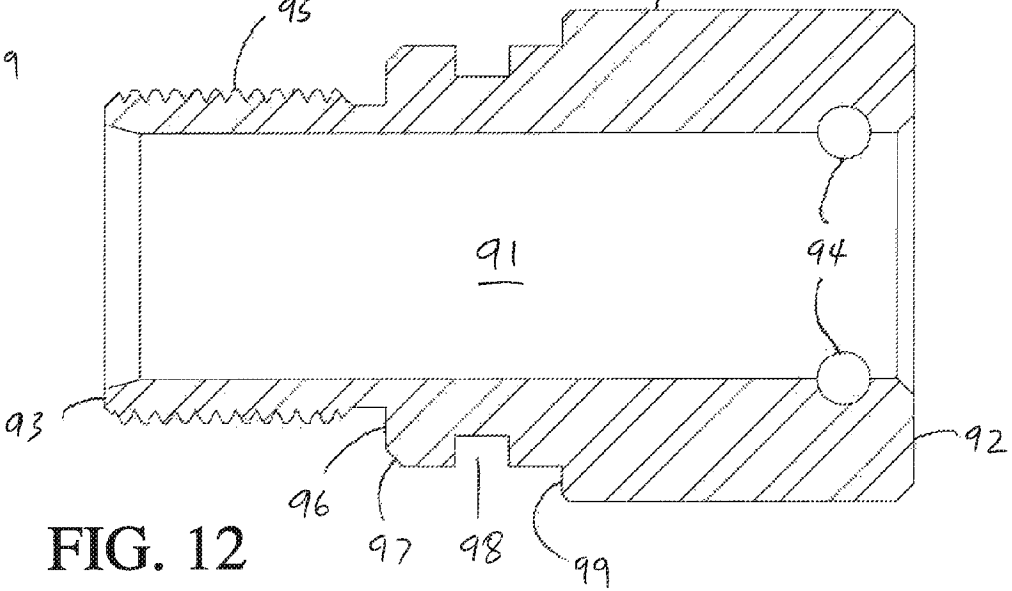
FIG. 12 is a cutaway view of the core sub component of the present invention.

As shown in FIGS. 11 and 12, core sub 90 is generally cylindrical in shape. Core sub 90 has a longitudinal bore 91 extending from one end 92 to the other end 93. Core sub 90 has two pin holes 94 near end 92 that are designed to align with the two tangent pin grooves 79 on core 70. Core sub 90 has a male thread 95 at end 93. Adjacent to male thread 95 is first shoulder 96, which has a beveled edge 97. Adjacent to first shoulder 96 is outer o-ring groove 98. Adjacent to outer o-ring groove 98 is second shoulder 99.

Figure 13:
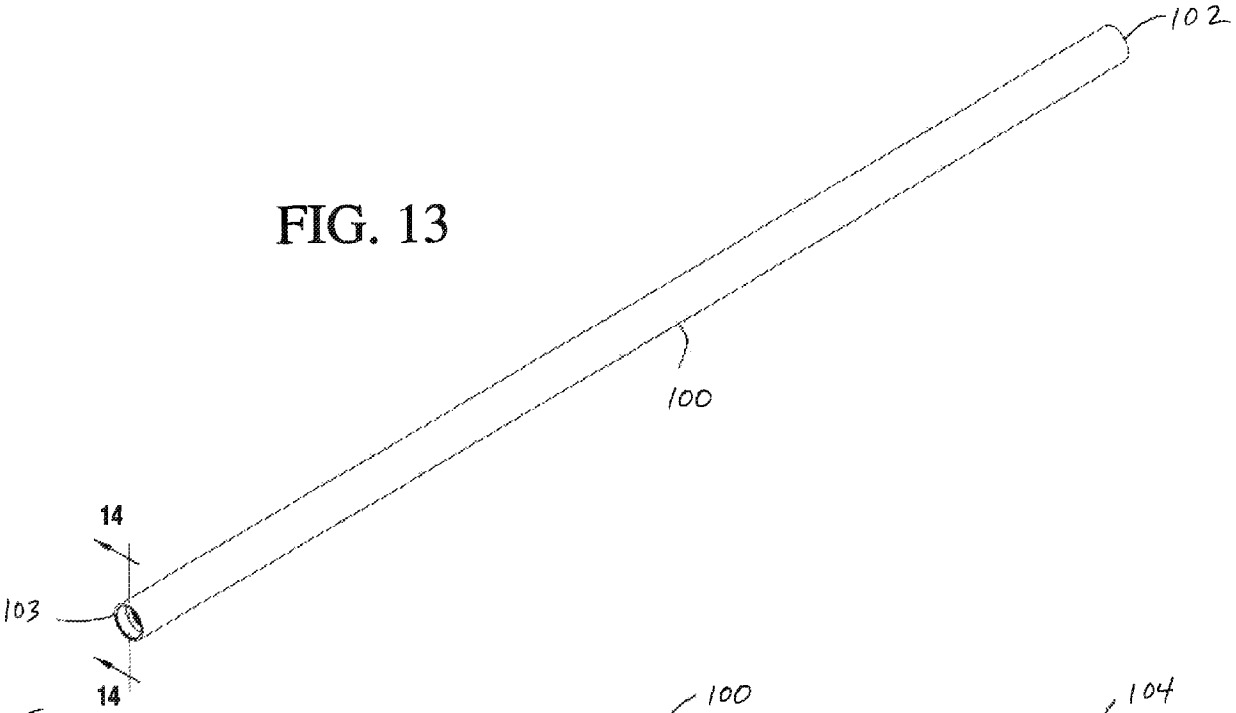
FIG. 13 is a perspective view of the fluid housing component of the present invention.
Figure 14:
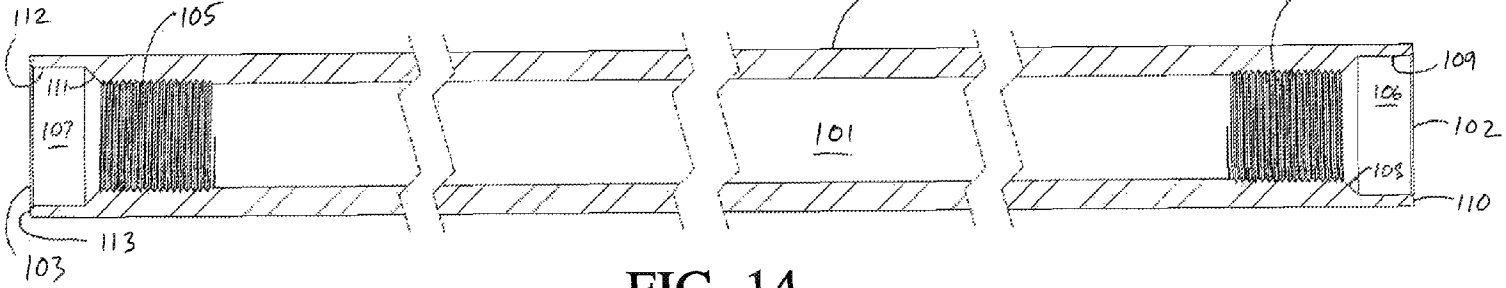
FIG. 14 is a cutaway view of the fluid housing component of the present invention.

As shown in FIGS. 13 and 14, fluid housing 100 is cylindrical in shape. Fluid housing 100 has a longitudinal chamber 101 extending from one end 102 to the other end 103. Fluid housing 100 has female threads 104 and 105 at each end 102 and 103, respectively. Female threads 104 and 105 are recessed within fluid housing 100, thereby creating openings 106 and 107, respectively. Opening 106 has a beveled edge 108, an inner wall 109, and a flange 110. Likewise, opening 107 has a beveled edge 111, an inner wall 112, and a flange 113.

Figure 15:
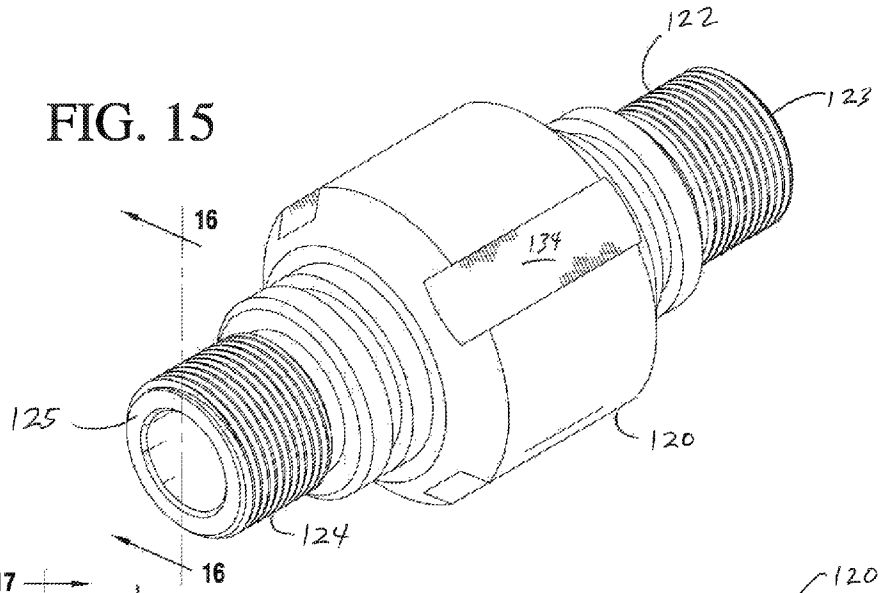
FIG. 15 is a perspective view of the "no go" component of the present invention.
Figure 17:
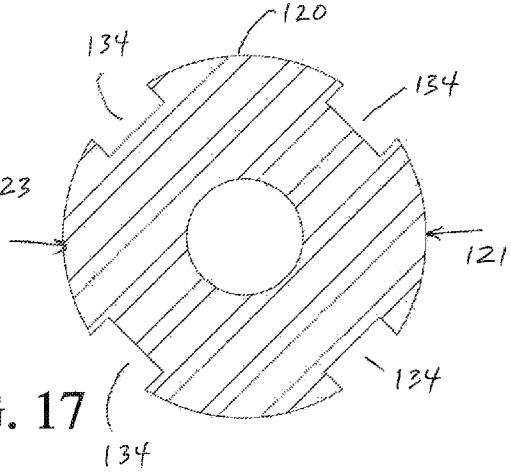
FIG. 17 is another cutaway view of the "no go" component of the present invention.
Figure 16:
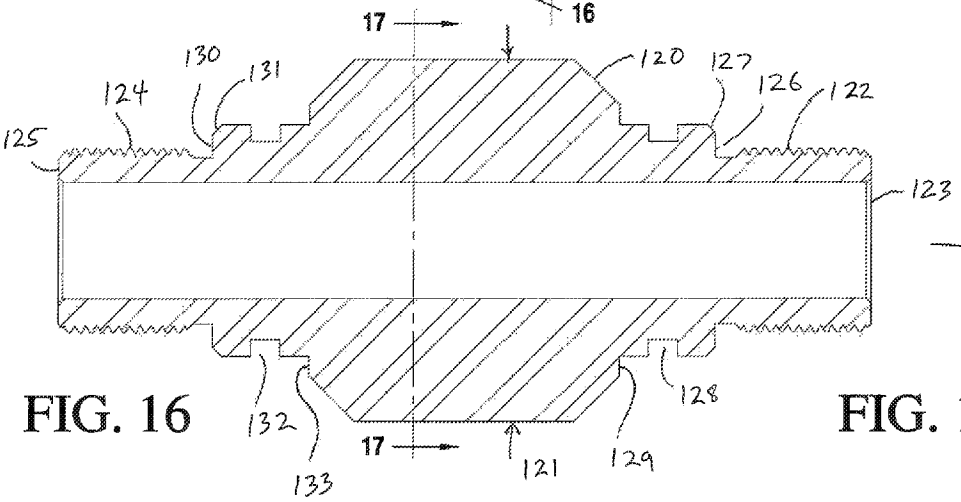
FIG. 16 is a cutaway view of the "no go" component of the present invention.

As shown in FIGS. 15, 16, and 17, no-go 120 is generally cylindrical in shape. Outer diameter 121 of no-go 120 varies depending on the dimensions of the down hole safety valve to be cleaned. No-go 120 is designed to stop at the polished bore of a down hole safety valve, so that multiple jet ports 150 of jet sub 140 are positioned directly at the hinge pin or sealing area of the flapper on the down hole safety valve.

No-go 120 has a male thread 122 at one end 123, and a male thread 124 at the other end 125. Adjacent to male thread 122 is first shoulder 126, which has a beveled edge 127. Adjacent to first shoulder 126 is outer o-ring groove 128. Adjacent to outer o-ring groove 128 is second shoulder 129. Adjacent to male thread 124 is first shoulder 130, which has a beveled edge 131. Adjacent to first shoulder 130 is outer o-ring groove 132. Adjacent to outer o-ring groove 132 is second shoulder 133. No-go 120 can be equipped with slots 134, which allow down hole materials and debris to pass by no-go 120 when it is being moved in or out of the well.

Figure 18:
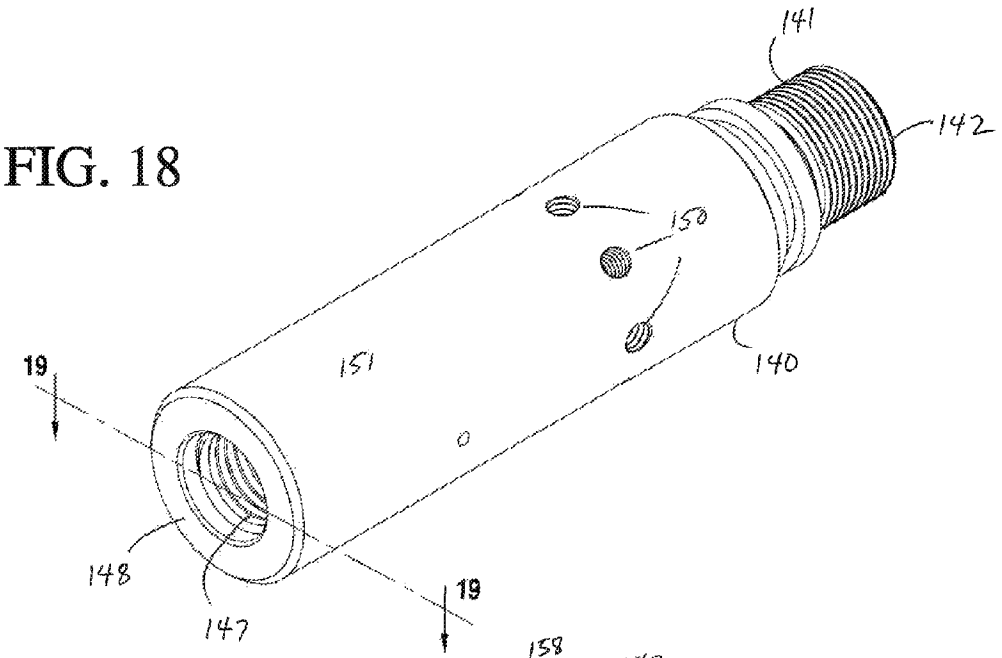
FIG. 18 is perspective view of the jet sub component of the present invention.
Figure 19:
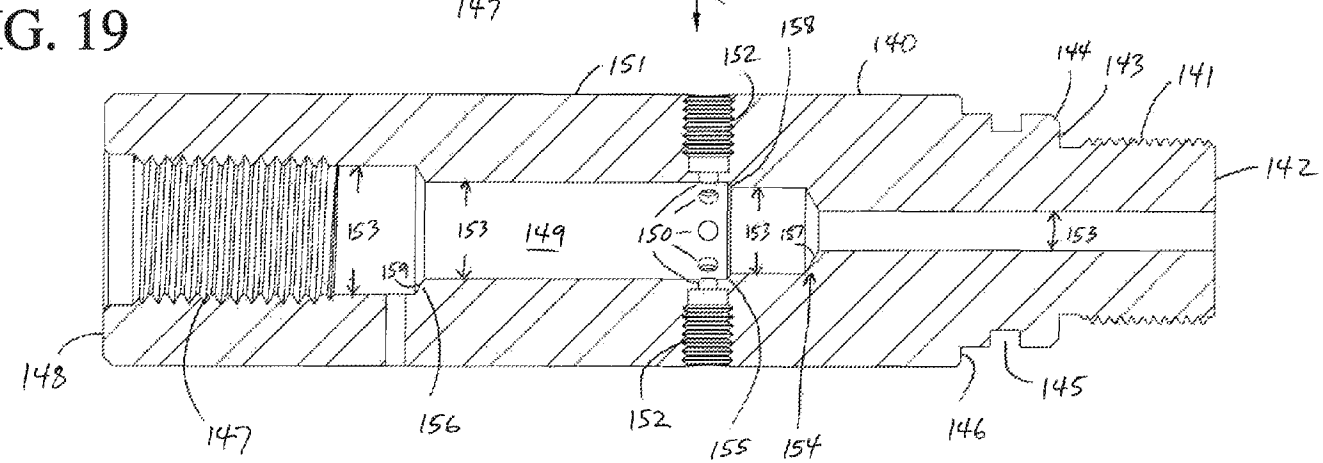
FIG. 19 is a cutaway view of the jet sub component of the present invention.

As shown in FIGS. 18 and 19, jet sub 140 is generally cylindrical in shape. Jet sub 140 has a male thread 141 at one end 142. Adjacent to male thread 141 is first shoulder 143, which has a beveled edge 144. Adjacent to first shoulder 143 is outer o-ring groove 145. Adjacent to outer o-ring groove 145 is second shoulder 146. Jet sub 140 has a female thread 147 at the other end 148.

Jet sub 140 has a longitudinal bore 149 that extends from end 142 to end 148. Beginning at end 142, inner diameter 153 of bore 149 increases at different locations 154, 155, and 156 along bore 149. Beginning at end 142, inner diameter 153 is approximately 0.25 inches. At change-of-diameter location 154, inner diameter 153 increases from approximately 0.25 inches to approximately 0.55 inches, resulting in bevel 157 at change-of-diameter location 154. At change-of-diameter location 155, inner diameter 153 increases from approximately 0.55 inches to approximately 0.625 inches, resulting in bevel 158 at change-of-diameter location 155. At change-of-diameter location 156, inner diameter 153 increases from approximately 0.625 inches to approximately 0.85 inches, resulting in bevel 159 at change-of-diameter location 156.

Between change-in-diameter locations 155 and 156, and near change-in-diameter location 155, jet sub 140 has multiple jet ports 150 that extend radially from bore 149 to outer surface 151 of jet sub 140. Jet ports 150 have female threads 152 for receiving jet inserts (not shown). Different jet inserts have different inner diameters to change the rate of fluid released from jet sub 140. Female threads 152 can also receive jet plugs (not shown), which are designed to prevent the release of fluids from jet sub 140 through one or more jet ports 150.

Figure 20:
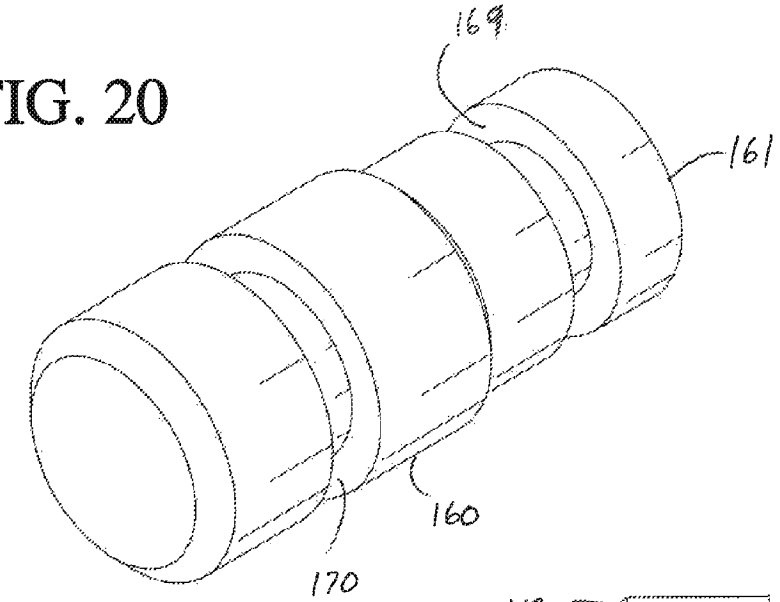
FIG. 20 is a perspective view of the piston for the jet sub component of the present invention.
Figure 21:
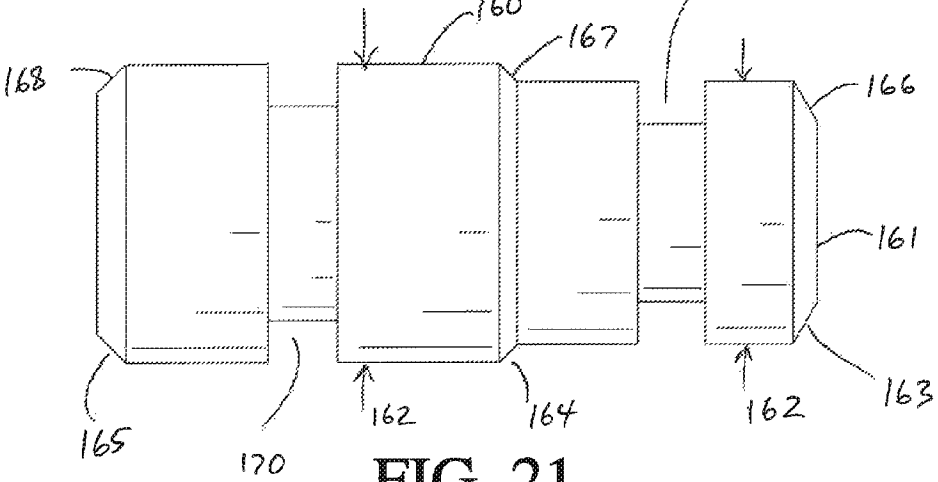
FIG. 21 is a side view of the piston for the jet sub component of the present invention.

As shown in FIGS. 20 and 21, jet sub piston 160 is generally cylindrical in shape. Beginning at one end 161, outer diameter 162 of jet sub piston 160 changes dimensions at different locations 163, 164, and 165. Beginning at end 161, outer diameter 162 of jet sub piston 160 is approximately 0.375 inches. At change-of-diameter location 163, outer diameter 162 increases from approximately 0.375 inches to approximately 0.548 inches, resulting in bevel 166 at change-of-diameter location 163. At change-of-diameter location 164, outer diameter 162 increases from approximately 0.548 inches to approximately 0.623 inches, resulting in bevel 167 at change-of-diameter location 164. At change-of-diameter location 165, outer diameter 162 decreases from approximately 0.623 inches to approximately 0.51 inches, resulting in bevel 168 at change-of-diameter location 165.

Jet sub piston 160 has an outer o-ring groove 169 between change-in-diameter locations 163 and 164, and an outer o-ring groove 170 between change-in-diameter locations 164 and 165.

When preparing present invention 10 for use, one method of connecting the components of present invention 10 begins with installing a quick connection and check valve (not shown) inside cavity 25 of top sub 20 (FIGS. 3 and 4).

Gas housing 30 (FIGS. 5 and 6) is connected to top sub 20 by screwing male thread 31 at end 39 of gas housing 30 into female thread 22 at end 27 of top sub 20, as shown in FIGS. 1 and 2. A threaded pressure relief plug (not shown) is installed in pressure relief port 45 on gas housing 30 by screwing the threaded pressure relief plug into female threads 47 until the threaded pressure relief plug is blocking pressure relief outlet 48.

Core top sub 50 (FIGS. 7 and 8) is connected to gas housing 30 by inserting male thread 51 at end 52 of core top sub 50 into opening 35 at end 40 of gas housing 30, and by screwing male thread 51 of core top sub 50 into female thread 32 of gas housing 30 until beveled edge 56 on first shoulder 55 of core top sub 50 is flush with bevel 36 of gas housing 30, and second shoulder 58 of core top sub 50 10 is flush with flange 38 of gas housing 30, as shown in FIGS. 1 and 2. An o-ring (not shown) installed in outer o-ring groove 57 of core top sub 50 provides a seal between core top sub 50 and gas housing 30 to prevent gas from escaping gas housing 30 and to prevent down hole materials and other debris from entering into gas housing 30.

Core sub 90 (FIGS. 11 and 12) is slid over core 70 (FIGS. 9 and 10) until end 93 of core sub 90 abuts head 80 of core 70. Core sub 90 is rotated on core 70 until pin holes 94 near end 92 on core sub 90 are aligned with tangent pin grooves 79 on outer surface 76 of core 70, as shown in FIG. 1. Shear pins 190 (shown in FIG. 1) are inserted into pin holes 94 and through tangent pin grooves 79, thereby securing core sub 90 and core 70 together until the down hole safety valve is ready to be cleaned, as discussed in more detail below. O-rings (not shown) installed in o-ring grooves 77 and 78 prevent the gas in gas housing 30 from being discharged anywhere other than into liquid housing 100, as discussed in more detail below.

Core 70 and core sub 90 are connected to core top sub 50 (FIGS. 7 and 8) by screwing male thread 71 near end 72 of core 70 into female thread 53 at end 54 of core top sub 50 until inner o-ring (not shown) installed in inner o-ring groove 60 provides a seal between core 70 and core top 50, as shown in FIGS. 1 and 2.

Fluid housing 100 (FIGS. 13 and 14) is connected to core 70 and core sub 90 by inserting male thread 95 at end 93 of core sub 90 into opening 106 at end 102 of fluid housing 100, and by screwing male thread 95 into female thread 104 of fluid housing 100 until beveled edge 97 on first shoulder 96 of core sub 90 is flush with beveled edge 108 of fluid housing 100, and second shoulder 99 of core sub 90 is flush with flange 110 of fluid housing 100, as shown in FIGS. 1 and 2. An o-ring (not shown) installed in outer o-ring groove 98 provides a seal at this connection to prevent gas and/or fluids from escaping fluid housing 100 and to prevent down hole materials and other debris from entering into fluid housing 100.

Figure 22:
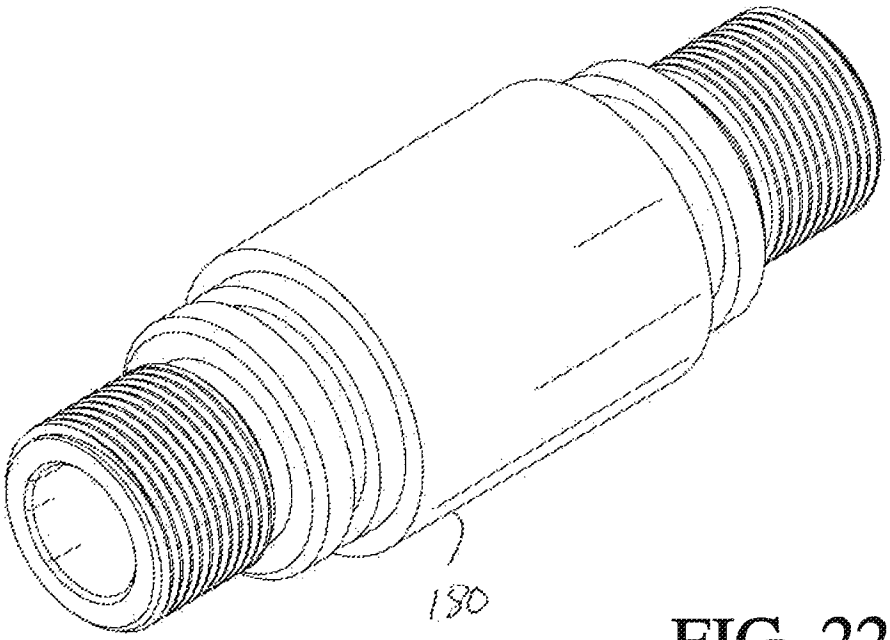
FIG. 22 is a perspective view of the crossover sub component of the present invention.

Depending on how much wash fluid is required to clean the sealing area of the down hole safety valve, more than one fluid housing 100 can be connected in series using crossover sub 180, as shown in FIG. 22.

No-go 120 (FIGS. 15, 16, and 17) is connected to the lowest of the series of fluid housing 100 connected to core 70 and core sub 90 by inserting male thread 122 at end 123 of no-go 120 into opening 107 at end 103 of fluid housing 100, and by screwing male thread 122 into female thread 105 of fluid housing 100 until beveled edge 127 on first shoulder 126 of no-go 120 is flush with beveled edge 111 of fluid housing 100, and second shoulder 129 of no-go 120 is flush with flange 113 of fluid housing 100, as shown in FIGS. 1 and 2. An o-ring (not shown) installed in outer o-ring groove 128 provides a seal at this connection to prevent gas and/or fluids from escaping no-go 120 and fluid housing 100, and to prevent down hole materials and other debris from entering into no-go 120 and fluid housing 100.

Another fluid housing 100 is connected to end 125 of no-go 120. The length of this fluid housing 100 depends on the dimensions of the down hole safety valve to be cleaned. The length of this fluid housing 100 should position multiple jet ports 150 of jet sub 140 directly at the hinge pin or sealing area of the flapper on the down hole safety valve. This fluid housing 100 is connected to no-go 120 by inserting male thread 124 at end 125 of no-go 120 into opening 106 at end 102 of fluid housing 100, and by screwing male thread 124 into female thread 104 of fluid housing 100 until beveled edge 131 on first shoulder 130 of no-go 120 is flush with beveled edge 108 of fluid housing 100, and second shoulder 133 of no-go 120 is flush with flange 110 of fluid housing 100, as shown in FIGS. 1 and 2. An o-ring (not shown) installed in outer o-ring groove 132 provides a seal at this connection to prevent gas and/or fluids from escaping no-go 120 and fluid housing 100, and to prevent down hole materials and other debris from entering into no-go 120 and fluid housing 100.

Jet sub 140 (FIGS. 18 and 19) is connected to the fluid housing 100 connected to the no-go 120 by inserting male thread 141 at end 142 of jet sub 140 into opening 107 at end 103 of fluid housing 100, and by screwing male thread 141 into female thread 105 of fluid housing 100 until beveled edge 144 on first shoulder 143 of jet sub 140 is flush with beveled edge 111 of fluid housing 100, and second shoulder 146 of jet sub 140 is flush with flange 113 of fluid housing 100, as shown in FIGS. 1 and 2. An o-ring (not shown) installed in outer o-ring groove 145 of jet sub 140 provides a seal at this connection to prevent gas and/or fluids from escaping fluid housing 100 and jet sub 140, and to prevent down hole materials and other debris from entering into fluid housing 100 and jet sub 140. Jet sub 140 preferably has eight 5/16 inch×20 tpi jet inserts (not shown) with 1/16 inch inner diameters. Jet sub 140 can be adjusted to operate with all eight jet ports 150 open or as few as one jet port 150 open to adjust the wash time of the present invention 10.

Jet sub piston 160 (FIGS. 20 and 21) is inserted into longitudinal bore 149 of jet sub 140 through end 148 of jet sub 140 until bevel 166 of jet sub piston 160 is flush with bevel 157 of jet sub 140, and bevel 167 of jet sub piston 160 is flush with bevel 158 of jet sub 140, as shown in FIGS. 1 and 2. In this position, o-rings in outer o-ring grooves 169 and 170 provide a seal on the up-hole and down-hole side of jet ports 150 of jet sub 140. The seals prevent wash fluid from draining out of fluid housing 100 and prevent down hole well pressure from pressurizing the present invention 10.

In use, the present invention 10 is designed to be lowered into a well having an open down hole safety valve (or other device). After gas housing 30 is pressurized with gas, and after liquid housing 100 is filled with wash fluid, the present invention 10 is lowered into the well until no-go 120 stops at the polished bore of the down hole safety valve, thereby positioning jet ports 150 of jet sub 140 at the hinge pin or sealing area of the flapper on the down hole safety valve. When the present invention 10 is in this position, a downward jarring force is exerted on the present invention 10, thereby shearing the shear pins 190 inserted into pin holes 94 (FIG. 1) and through tangent pin grooves 79, thereby disengaging core 70 and core sub 90, allowing core 70 to slide down core sub 90, which causes the pressurized gas in gas housing 30 to discharge through port 75 of core 70 into the series of fluid housings 100. The pressurized gas exiting port 75 of core 70 forces the liquid in the series of fluid housings 100 to flow through one or more of the multiple jet ports 150 in jet sub 140. When the wash is complete, the present invention 10 is removed from the well. The operator can then close the down hole safety valve to verify that the present invention 10 successfully cleaned the seal of the valve.

In one embodiment of the present invention, the present invention 10 is a low pressure tool having a working pressure of 5,000 psi. This low pressure tool enables the operator to pressurize gas housing 30 to 1,100 psi over shut in tubing pressure, and fill fluid housings 100 with a wash fluid such as water, diesel or hydrochloric acid, as determined by the production of the well.

In another embodiment of the present invention, the present invention 10 is a high pressure tool having a working pressure of 15,000 psi. This high pressure version of the present invention operates with a power charge similar to the charges used in a bridge plug setting tool. This embodiment of the present invention would require a licensed Explosive technician to operate the present invention. The technician would insert the proper size power charge into gas housing 30, fill fluid housing 100 with fluid and insert a drive piston (not shown) into fluid housing 100 above the fluid. The means of deployment determines the firing device used above gas housing 30. If the present invention is run using slickline, the technician would us an electronic firing device or a drive down firing head to initiate the power charge. If the present invention is run on electric line, the technician would simply fire the tool using the shooting panel in the electric line unit. The high pressure version of the present invention has a safety relief cut into the lower section of the fluid chamber allowing the excess gas the vent to the well bore when the drive piston reaches this relief.

The present invention can be configured in several ways to perform several functions beyond cleaning valves. For example, the operator can use the present invention to wash debris from a tubing plug in a landing nipple that is filled with debris which is preventing the plug from being equalized or pulled. As another example, the present invention can be used to remove scale from a landing nipple that is unable to lock.

It is understood that several embodiments of the present invention have been disclosed by way of example and that other modifications and alterations may occur to those skilled in the art without departing from the scope and spirit of the present invention.

What is claimed is:

1. A tool for cleaning a debris from a device positioned in a subterranean well comprising:

a top sub configured for downhole deployment on a work string, the top sub including an internal cavity;

a gas housing including an internal gas chamber for storing a pressurized gas, wherein the internal gas chamber is in fluid communication with the internal cavity of the top sub;

a core top sub operatively connected to the gas housing, the core top sub including an internal longitudinal bore extending therethrough, wherein the internal longitudinal bore is in fluid communication with the internal gas chamber of the gas housing;

a core operatively connected to the core top sub, the core including an outer surface and an internal longitudinal bore extending partially therethrough, the core including a port radially extending from the internal longitudinal bore to the outer surface, wherein the internal longitudinal bore and the port are in fluid communication with each other and with the gas chamber of the gas housing, wherein the outer surface includes a head with a plurality of slots for passage of the pressurized gas;

a core sub operatively connected in sliding engagement with the core, the core sub and core configured to be fixedly attached to each other during deployment of the tool downhole and slidably detached from each other when the tool has been operatively placed in position downhole to clean the device;

at least two wash-fluid housings operatively interconnected by a no-go component, the at least two wash-fluid housings each including an internal wash-fluid chamber for storing a wash fluid, the no-go component including an internal bore providing fluid communication between the wash-fluid chambers of the at least two wash-fluid housings; wherein the no-go component is configured to act as a stop for operative placement of the tool downhole to clean the device; and a jet sub operatively connected to one of the at least two wash-fluid housings, the jet sub including an outer surface and an internal longitudinal bore in fluid communication with a plurality of jet ports radially extending from the internal longitudinal bore to the outer surface, wherein the internal longitudinal bore and the plurality of jet ports are in fluid communication with the wash-fluid chambers of the at least two wash-fluid housings.

2. The tool of claim 1, further comprising a jet sub piston in sealing engagement with the internal longitudinal bore of the jet sub.

3. The tool of claim 2, wherein the work string is a slickline or electric line.

4. The tool of claim 2, wherein the top sub includes a vent port and a drain port.

5. The tool of claim 2, wherein the pressurized gas is an inert gas.

6. The tool of claim 5, wherein the inert gas is nitrogen.

7. The tool of claim 2, wherein the gas housing includes a pressure relief port.

8. The tool of claim 2, wherein the core includes at least one tangent pin groove on the outer surface, wherein the core sub includes at least one pin hole extending therethrough, and wherein the tool further comprises at least one shear pin configured for insertion into a recess formed by alignment of the at least one pin groove and the at least one pin hole for fixed attachment of the core and core sub to each other during deployment of the tool downhole.

9. The tool of claim 8, wherein a shearing of the at least one shear pin causes the slidable detachment of the core and core sub from each other when the tool has been operatively placed in position downhole to clean the device.

10. The tool of claim 2, wherein the plurality of jet ports comprises eight jet ports.

11. The tool of claim 1, wherein the device is a downhole safety valve.

12. The tool of claim 1, wherein the wash-fluid is selected from the group consisting of water, diesel, and hydrochloric acid.

13. A method of cleaning a debris from a device positioned in a subterranean well comprising the steps of:

a) providing a tool for cleaning the debris from the device comprising: a top sub configured for downhole deployment on a work string, the top sub including an internal cavity; a gas housing including an internal gas chamber for storing a pressurized gas, wherein the internal gas chamber is in fluid communication with the internal cavity of the top sub; a core top sub operatively connected to the gas housing, the core top sub including an internal longitudinal bore extending therethrough, wherein the internal longitudinal bore is in fluid communication with the internal gas chamber of the gas housing; a core operatively connected to the core top sub, the core including an outer surface and an internal longitudinal bore extending partially therethrough, the core including a port radially extending from the internal longitudinal bore to the outer surface, wherein the internal longitudinal bore and the port are in fluid communication with each other and with the gas chamber of the gas housing, wherein the outer surface includes a head with a plurality of slots for passage of the pressurized gas; a core sub operatively connected in sliding engagement with the core, the core sub and core configured to be fixedly attached to each other during deployment of the tool downhole and slidably detached from each other when the tool has been operatively placed in position downhole to clean the device; at least two wash-fluid housings operatively interconnected by a no-go component, the at least two wash-fluid housings each including an internal wash-fluid chamber for storing a wash fluid, the no-go component including an internal bore providing fluid communication between the wash-fluid chambers of the at least two wash-fluid housings; wherein the no-go component is configured to act as a stop for operative placement of the tool downhole to clean the device; and a jet sub operatively connected to one of the at least two wash-fluid housings, the jet sub including an outer surface and an internal longitudinal bore in fluid communication with a plurality of jet ports radially extending from the internal longitudinal bore to the outer surface, wherein the internal longitudinal bore and the plurality of jet ports are in fluid communication with the wash-fluid chambers of the at least two wash-fluid housings;

b) deploying the tool downhole until the no-go component stops at the device thereby preventing further downward deployment of the tool and positioning the jet ports of the jet sub adjacent a debris area of the device;

c) causing the core and core sub to be slidably detached from each other whereby the core slides down the core sub causing fluid communication between the gas chamber of the gas housing and the wash-fluid chambers of the at least two wash-fluid housings;

d) flowing the pressurized gas from the gas chamber of the gas housing to the wash-fluid thereby forcing the wash-fluid to exit from the wash-fluid chambers and enter the internal longitudinal bore of the jet sub;

e) causing the wash-fluid to flow from the internal longitudinal bore of the jet sub to the plurality of jet ports whereupon the wash-fluid exits the jet ports and cleans the debris area of the device thereby removing the debris from the device.

14. The method of claim 13, further comprising the steps of:

f) pulling the tool from the well after the debris has been removed from the device.

15. The method of claim 13, wherein the device is selected from the group consisting of a downhole safety valve, a tubing plug in a landing nipple and a landing nipple.

16. The method of claim 13, wherein in step (b) the tool is deployed downhole on a work string.

17. The method of claim 16, wherein the work string is a slick line or an electric line.

18. The tool of claim 13, wherein the pressurized gas is an inert gas.

19. The tool of claim 18, wherein the inert gas is nitrogen.

20. The tool of claim 13, wherein the wash-fluid is selected from the group consisting of water, diesel, and hydrochloric acid.

21. The method of claim 13, wherein the jet sub of the tool further comprises a jet sub piston in sealing engagement with the internal longitudinal bore of the jet sub and wherein in step (e) the wash-fluid entering the internal longitudinal bore of the jet sub causes a downward displacement of the jet sub piston thereby permitting the wash-fluid to flow from the internal longitudinal bore to the plurality of jet ports of the jet sub.

* * * * *